United States Patent [19]

Thomas et al.

[11] 4,379,979

[45] Apr. 12, 1983

[54] CONTROLLED POROSITY SHEET FOR THERMIONIC DISPENSER CATHODE AND METHOD OF MANUFACTURE

[75] Inventors: Richard E. Thomas, Riverdale; Richard F. Greene, Bethesda, both of Md.

[73] Assignee: The United States of America as represented by the Secretary of the Navy, Washington, D.C.

[21] Appl. No.: 232,444

[22] Filed: Feb. 6, 1981

[51] Int. Cl.[3] ..... H01J 1/14; H01J 19/06; H01K 1/04

[52] U.S. Cl. ..... 313/346 R; 313/337; 313/346 DC; 427/77; 428/596

[58] Field of Search ..... 313/346, 346 DC, 348, 313/337; 428/596; 427/77

[56] References Cited

U.S. PATENT DOCUMENTS

| | | | |
|---|---|---|---|
| 3,226,265 | 8/1969 | Reuschel et al. | 313/346 |
| 3,753,025 | 4/1972 | Van Stratum et al. | 313/346 |
| 3,879,830 | 6/1973 | Buescher | 313/346 |
| 4,101,800 | 7/1978 | Thomas et al. | 313/346 R |
| 4,165,473 | 10/1979 | Falce | 313/346 |
| 4,254,357 | 3/1981 | Haas et al. | 313/348 |
| 4,310,603 | 1/1982 | Falce | 313/346 R |

*Primary Examiner*—Saxfield Chatmon, Jr.

*Attorney, Agent, or Firm*—Robert F. Beers; William T. Ellis; Kenneth E. Walden

[57] ABSTRACT

A controlled porosity sheet defining a surface for a thermionic dispenser cathode and a method of manufacture. Starting with a generally flat silicon template substrate structure having an array of upstanding microposts 1–25 microns across on 5–100 micron spacings from each other, a layer of metal is deposited on the substrate to surround the microposts and cover the substrate structure to a desired depth. The metal layer is then abraded to a smooth, flat surface which exposes the microposts. Thereafter, the silicon substrate and microposts are completely etched away, leaving a metal sheet having micron-size holes therethrough.

18 Claims, 14 Drawing Figures

U.S. PATENT 4,101,800

(4000X)

(650X)

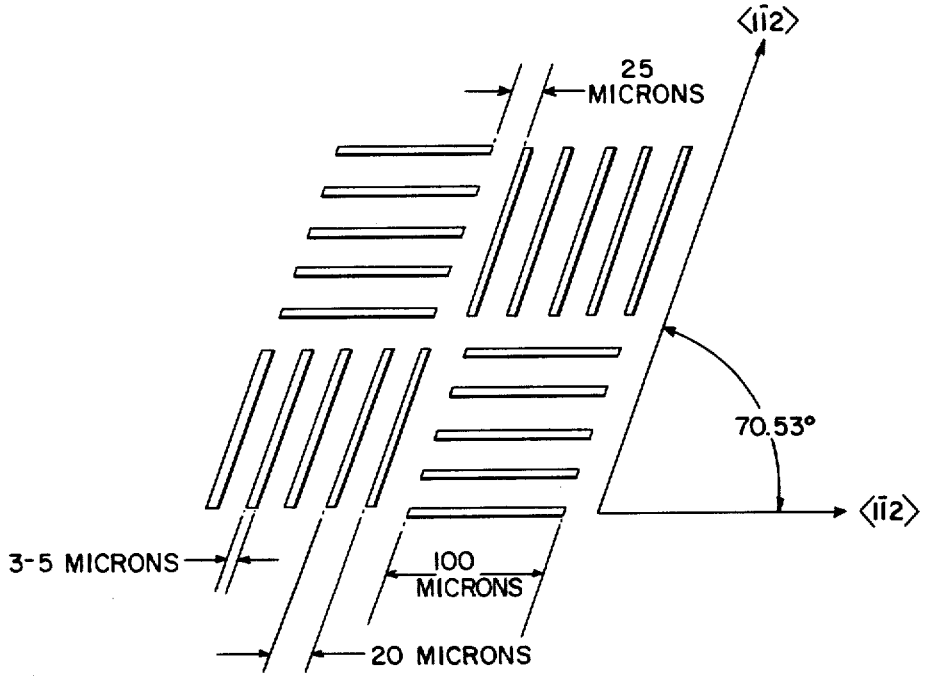
REPEAT PATTERN FOR CPD CATHODE
FIG. 8
FIG. 9
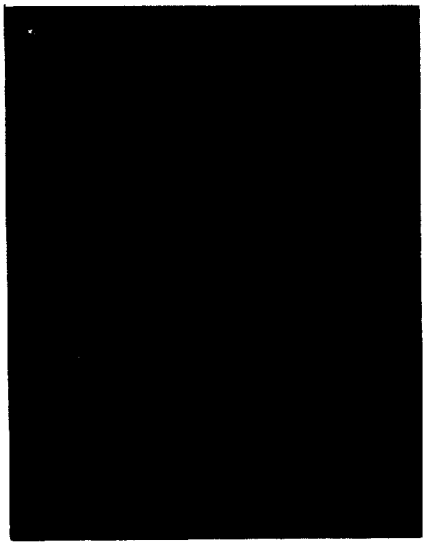
(475X)

CONTROLLED POROSITY SHEET FOR THERMIONIC DISPENSER CATHODE AND METHOD OF MANUFACTURE

BACKGROUND OF THE INVENTION

Thermionic dispenser cathodes have previously been fabricated by using a process of pressing and sintering metal powder so as to produce a material having a random distribution of holes or pores which are subsequently impregnated with active cathode materials, e.g., compounds of alkaline earth metals well-known in the art, or, a reservoir of these compounds may be positioned behind the sintered matrix. During operation, activating materials, such as Ba/BaO, are generated and migrate through the sintered metal pores out onto the emitting surface at operating temperatures. As is disclosed in U.S. Pat. No. 4,101,800, Thomas et al., the dimensions of the individual pores and the pattern of the pore arrays can exert a sizable influence over the potential performance of the cathode. Hence, it is desirable for the dispenser cathode to be a controlled porosity dispenser (CPD) cathode.

Current techniques available for making a uniform array of holes in the surface layer of the controlled porosity dispenser cathode (CPD) are not able to fabricate a porous structure at the optimum theoretical design. While successful CPD cathodes with Ba/BaO impregnants have been fabricated, theoretical calculations have determined that closer hole spacings and smaller hole diameters are required in order to optimize the emission properties and resultant life expectancy of the cathode. Current techniques, however, are limited to a minimum pore width of about 25 microns, and pore spacings of the order to 35 microns. These dimension are limited due to the fact that the minimum hole diameter which can be etched using conventional techniques is approximately equal to the thickness of the sheet being etched through. Since a minimum covering foil thickness of about 25 microns is required for sufficient mechanical strength and reliability, the smallest hole diameters and spacings thus far that have been achieved in practical CPD cathode surfaces are 25 micron holes on 35 micron spacings. In contrast, theoretical studies have shown that optimum emission characteristics are obtained when pore widths of 1–10 microns, pore spacings of 5–50 microns, and CPD sheet thicknesses of 25–100 microns are employed.

SUMMARY OF THE INVENTION

This invention relates to a controlled porosity sheet, and method of manufacture, for use as a surface in front of a thermionic dispenser material, or other matrix type cathode. Holes through the sheet and their spacings are in the range of just a few microns. With control over porosity or hole sizes and spacings in the sheet to within such small dimensions, cathode output can be optimized according to application.

OBJECTS OF THE INVENTION

It is therefore an object of this invention to provide a controlled porosity dispenser cathode having superior emission and longevity characteristics.

It is another object of this invention to provide a cathode dispenser covering sheet 25–100 microns thick having holes therethrough of 1–10 microns wide on spacings of 5–50 microns, and a method of manufacture.

It is still another object of this invention to provide an improved and mechanically reliable thermal conductive cathode dispenser, and method of manufacture.

Other objects of the invention and method of manufacture, will become apparent upon consideration of the specification, claims and drawings.

BRIEF DESCRIPTION OF THE DRAWINGS

FIG. 8 shows a surface pattern of slots for a controlled porosity sheet.

FIG. 9 is a photomicrograph (475×) of a metal sheet formed from the pattern of FIG. 8 according to the method of this invention.

DESCRIPTION OF THE INVENTION

The improved porous sheets produced by the method of this invention are useful with cathodes such as that discussed in U.S. Pat. No. 4,101,800 issued to Richard E. Thomas on July 18, 1978.

Figure 1A:
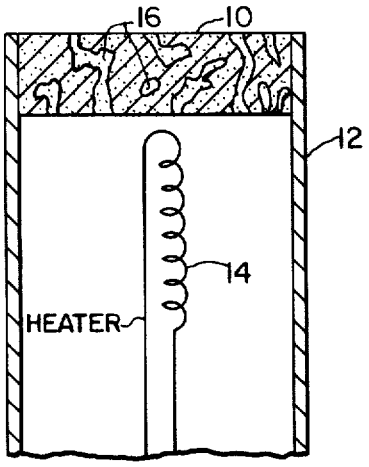
PRIOR ART FIG. 1a
FIG. 1*a* is a cross-section view through an early dispenser cathode according to the prior art.
Figure 1B:
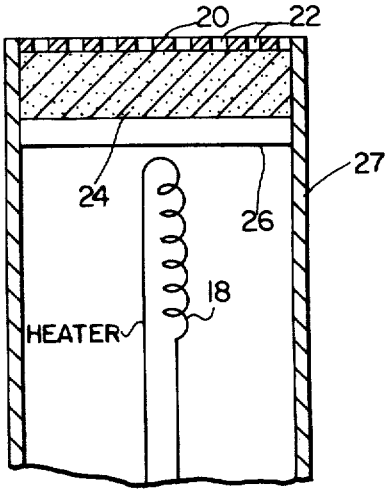
FIG. 1*b* is a cross-sectional view through a later dispenser cathode according to U.S. Pat. No. 4,101,800.

Reference may be made to FIGS. 1*a* and 1*b*, which illustrate the differences between the cathode disclosed in the Thomas patent and a prior art dispenser cathode then in use. The prior art cathode features a sintered porous metal matrix 10 inserted inside a molybdenum sleeve 12. Heater 14 is positioned behind the matrix and serves to activate the materials, e.g. Ba and BaO, which has been impregnated in pores 16 which formed after sintering.

The controlled porosity dispenser cathode (CPDC) disclosed in FIG. 1*b* (Thomas, U.S. Pat. No. 4,101,800) features, instead of the sintered metal, a thin foil or sheet 20 having an array of pores or holes 22 overlaying a reservoir 24 of barium, calcium and strontium carbonates, which, in turn, is backed in plug 26 of refractory metal, such as tantalum or impregnated tungsten, inside a molybdenum sleeve 27. The cathode material is activated by heater 18.

Figure 2:
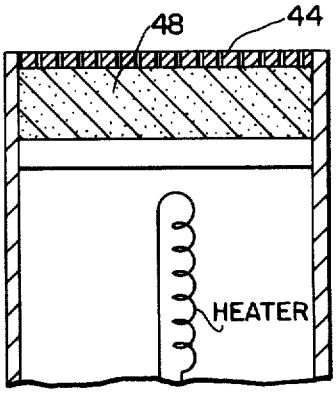
FIG. 2 is a cross-sectional view through a dispenser cathode including a covering sheet with much smaller holes therethrough provided according to the present method.
Figure 3:
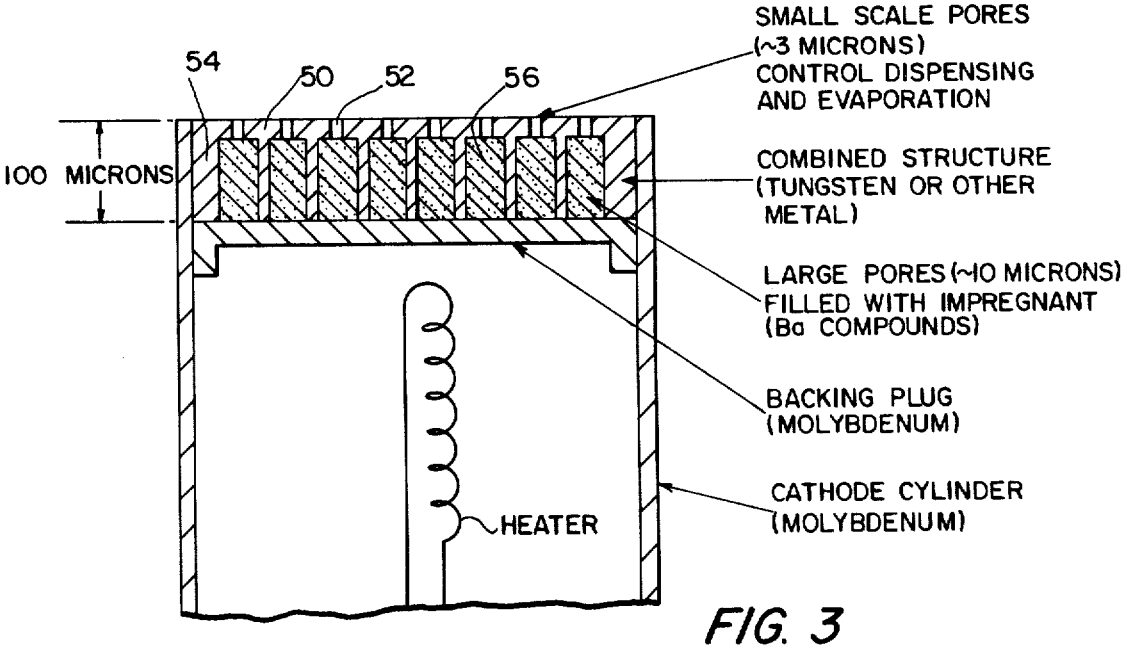
FIG. 3 is a cross-sectional view through another dispenser cathode according to the present invention wherein the cathode reservoir and covering sheet are intergrated.
Figure 4A:
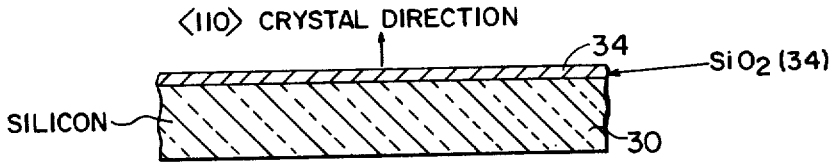
FIGS. 4*a*, 4*b* and 4*c* represent etching steps to form a silicon substrate with free and upstanding microposts for use in the method of the present invention.
Figure 4B:
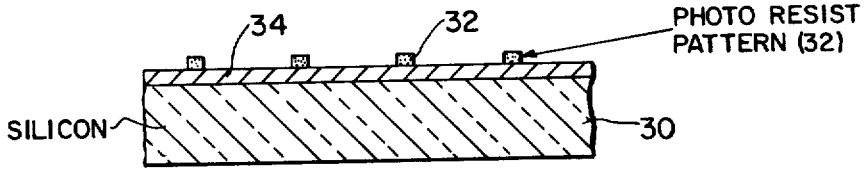
Figure 4C:
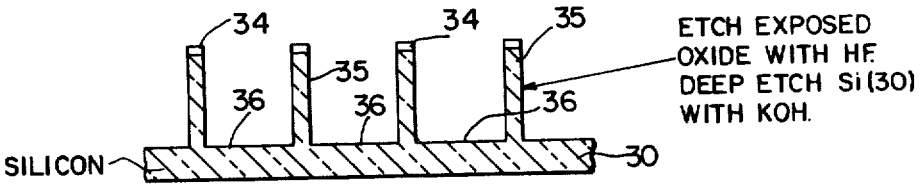

A controlled porosity sheet or foil with superior characteristics over foil or sheet 20 in Thomas (U.S. Pat. No. 4,101,800) is seen in FIGS. 2 and 3. The steps of producing a substrate with upstanding microposts as illustrated in FIGS. 4a, 4b and 4c are known in the prior art. They will be discussed briefly herein because the product defines a substrate used in the method steps of this invention illustrated in FIGS. 5a, 5b and 5c. Substrate 30, which is a single crystal layer of silicon, and preferably of <110> silicon orientation, is treated with a photolithographic technique used in integrated circuit art to produce an array of silicon posts or slabs, sticking up from the face of substrate 30. The technique is to deposit a photo resist pattern 32 upon a layer 34 of $SiO_2$ which coats substrate 30. The precise geometry of the array desired is determined by the pattern of holes in the photoresist which is exposed by radiation. After the resist pattern is developed, the $SiO_2$ is etched away by dilute HF acid. The wafer is then exposed to an etching solution, preferably aqueous KOH, (or ethylene diamine pyrocatechol, or other crystallographically orientation-dependent etch) which has the distinctive characteristic of etching silicon crystal surface faces, e.g., the <110> face etches orders of magnitude faster than, for example, the <111> surface of silicon. By using as a substrate a <110> silicon surface and masking slots (using photoresist) along <112> directions in this surface, an etch on the surface produces the geometry illustrated in FIG. 4c with microposts 35 having <111> sides perpendicular to the <110> surface 36. It is possible by the above process to produce a silicon substrate 30 having upstanding microposts 35 of heights many times their thicknesses. More precisely, the process can produce from a substrate 30, having an initial thickness of 25-100 microns, an array of upstanding microposts 35 which are 1-25 microns wide by around 100 microns long on 1-100 micron spacings.

Figure 5A:
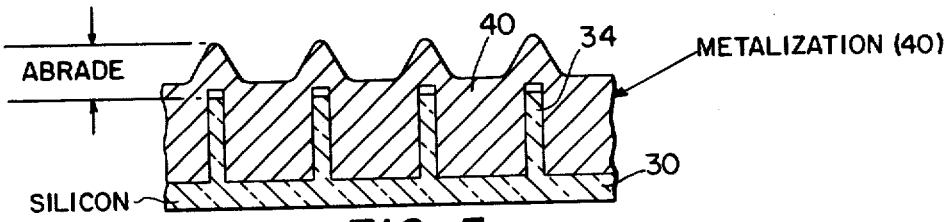
FIGS. 5*a* shows a silicon substrate according to FIG. 4*c* over which a metal layer has been applied.
Figure 5B:
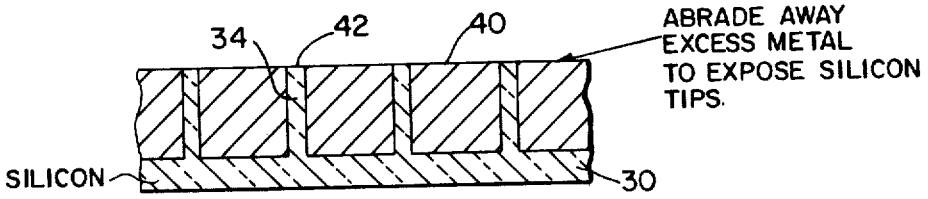
FIG. 5*b* shows the metal layer of FIG. 5*a* after its surface has been abraded away to expose silicon miniposts.
Figure 5C:
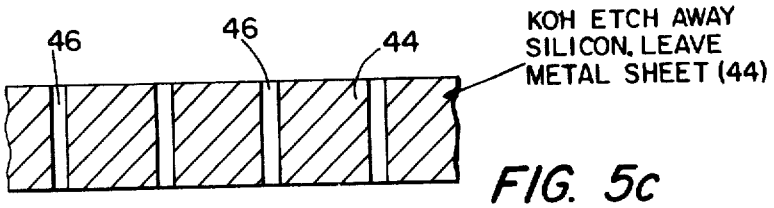
FIG. 5*c* shows a finished metal layer sheet after the silicon substrate and miniposts of FIG. 5*b* have been etched away thus leaving holes therethrough.

Starting with substrate 30, produced according to a method known in the art and illustrated in FIGS. 4a through 4c, further processing is conducted according to the present invention. A metal 40, e.g., tungsten, is applied on substrate 30 such as by physical or chemical deposition, ion plating, sputtering, or by application of fine (~1 micron) metal particles to fill the spaces between upstanding microposts or slabs 35 to cover them as illustrated in FIG. 5a. A top layer of the applied metal 40 is then abraded away to provide a desired thickness of the metal and in the process expose cross sectional ends 42 of substrate microposts 35. The silicon substrate 30, including microposts 35, is then etched away using an etchant that does not attack the metal itself. There is left a relatively thick sheet 44 with a uniform structure of pores or holes 46 in place of miniposts 35. These holes or pores are from 1-25 microns on spacings of 5-100 microns. The thickness of the sheet produced in the final step illustrated in FIG. 5c is dependent on the etching depth on the silicon substrate (FIG. 4c) and the method of metal application. Since the ratio of the etching depth to lateral dimension of the unetched posts or lands can be very high. The production of, for example, 2 micron wide slots or holes on 10 micron spacings in 100 micron thick sheets is possible. It has not heretofore been possible to provide such fine openings on close spacings in such relatively thick sheets. Since the sheets may be near 100 microns thick, they have sufficient rigidity and mechanical reliability for relatively free standing service when positioned in front of a cathode material shown in FIG. 2.

Figure 6:
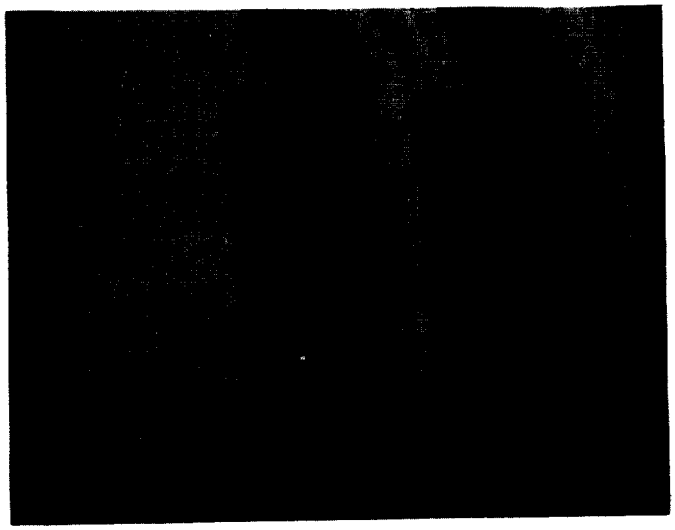
FIG. 6 is a photomicrograph (4000×) showing the microposts upstanding from a silicon substrate.
Figure 7:
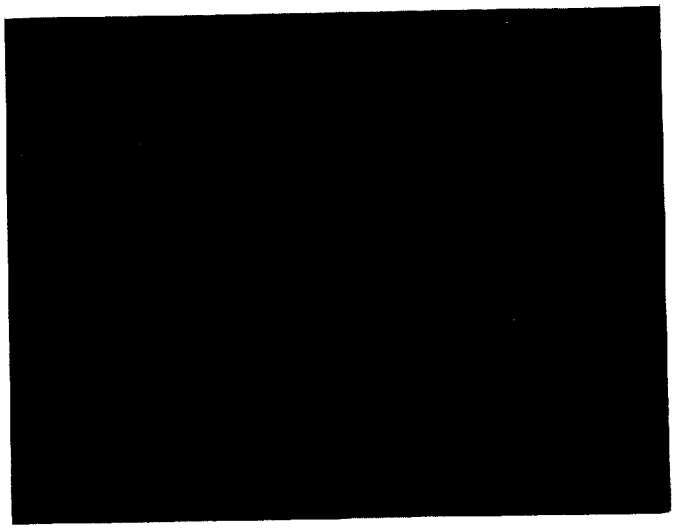
FIG. 7 is another photomicrograph (650×) showing the deposited metal after the silicon substrate has been etched away.

FIG. 6 is a photomicrograph (4000×) of a silicon substrate etched in accordance with the disclosure herein to have posts approximately 5 microns wide by 25 microns deep. FIG. 7 is another photomicrograph in perspective view of a test sheet of nickel (4-25 micron slots) wherein the nickel was formed by physical vapor deposition on a silicon substrate similar to that shown in FIG. 4c. These structures reveal the practical realization of small holes or slots in relatively thick sheets.

The pattern of pore structures shown in FIG. 8 is one of several possible patterns that would be consistent with this technology. The slots (holes) can be from 1-25 microns wide, and from 1-several 100 microns long, with arbitrary width to length ratios. The pattern can be repeated by known photolithography mask forming techniques to cover an area of approximately one square inch on a silicon wafer. This would provide a sheet large enough to be subdivided to make surfaces for several dispenser cathodes of typical size. This method can be used in forming sheets compatible with several different materials, for example, nickel, tungsten and iridium, from which the majority of thermionic cathodes are made.

FIG. 9 is a photomicrograph (475×) of the surface of finished sheet 44 processed according to this invention.

With precise etching structures that can be obtained by a technique illustrated in FIGS. 4a, 4b and 4c, it is possible to integrate the cathode reservoir and controlled porosity surface. Such a configuration is illustrated in FIG. 3 where a controlled porosity surface 50, having small holes or pores 52 of the dimensions previously described, is combined or utilized with structure 54. This embodiment is processed from a silicon substrate by first etching small openings on one side and then etching larger openings on the other side in registry with the initial pattern. The metal structure is then formed by depositing the desired metal on both sides of the silicon matrix and etching away the silicon substrate in the manner previously described. Large pores 56 are filled or impregnated with barium compounds which migrate through openings 52 in the previous sheet 50 to cover the surface thereof.

Many electron gun designs for high power microwave tubes require the emitting surface to be concave. Since the CPD sheets are very thin, they may be made concave by either punching the previous sheets on a convex surface or by sintering the sheets while sandwiched between mating concave and convex surfaces.

There has been disclosed a process for manufacturing various sheets or screens for use in front of a cathode material. Obviously, many changes and modifications can be made thereto and remain within the spirit and scope of the invention which is limited only by the scope of the claims annexed hereto.

What is claimed and desired to be secured by Letters Patent of the United States is:

1. A method of making a controlled porosity surface sheet useful in cathode structures comprising:

manufacturing a substrate of single crystal silicon which has a predetermined array of microposts upstanding from the substrate, said manufacturing including the step of etching the substrate surface in a crystallographically orientation-dependent etch;

applying a metal layer upon the silicon substrate to a desired thickness including covering the microposts;

abrading the resultant structure in order to remove the surface metal and expose tips of the microposts; and etching away the silicon substrate including the microposts with an anisotropic etching agent to leave a porous sheet.

2. The method according to claim 1 further defined by the step of selecting a single crystal silicon substrate with <110> orientation toward the surface in which the microposts are to be formed by etching.

3. The method according to claim 2 involving the step of etching the substrate surface in ethylene diamine pyrocatechol.

4. The method according to claim 1 or 2 involving the step of etching the substrate surface in aqueous KOH.

5. The method according to claim 1, 2 or 4 wherein the substrate surface is etched to define upstanding microposts of 1-25 microns in one lateral dimension on spacings of 5-100 microns.

6. The method according to claims 1 or 2 wherein the substrate surface is etched in KOH to define upstanding miniposts from 1-25 microns in one transverse dimension and 25-100 microns in another transverse dimension by 25-100 microns high on spacings of 5-100 microns.

7. The method of claim 1 wherein the method of depositing a metal layer is selected from the group of physical vapor deposition, chemical vapor deposition, ion plating, sputtering, and depositing and subsequent sintering of small particles.

8. The method according to claim 7 wherein the metal applied is selected from the group consisting of nickel, tungsten, irridium, rhenium, osmium and alloys thereof.

9. The method according to claim 7 wherein the metal is tungsten.

10. The method according to claim 1 wherein the anisotropic etching agent etches substantially only in the direction in which the silicon microposts are to protrude.

11. The method according to claim 10 further defined by the step of performing the anisotropic etching step in a crystallographically orientation-dependent etch.

12. The method according to claim 11 where the etching step is performed in aqueous KOH.

13. The method according to claim 4 wherein the substrate surface is etched to define upstanding microposts of 1-25 microns in one lateral dimension on spacings of 5-100 microns.

14. The method according to claim 4 wherein the substrate surface is etched in KOH to define upstanding microposts from 1-25 microns in one transverse dimension and 25-100 microns in another transverse dimension by 25-100 microns high on spacings of 5-100 microns.

15. In a thermionic dispenser type cathode having an emissive member comprising a backing plug, active cathode material adjacent the backing plug and a thin foil facing the backing plug, the foil being formed from at least one refractory metal with a set of uniformly sized and spaced holes therein to permit the active cathode material to migrate through the holes and to spread over the exposed surface of the foil when the active cathode material is heated to the proper temperature, the improvement which comprises the holes having a pore width of 1-25 microns on the side of the foil facing away from the cathode material and a larger pore width of 25-100 microns on the other side, pore spacings of from 5-100 microns, and foil thickness from 25-100 microns, said active cathode material substantially filling the portion of the pores having the larger pore width.

16. The invention according to claim 15 wherein the foil is tungsten.

17. The invention according to claim 15 wherein the holes communicating with the other surface extends a substantial distance into the foil to define reservoirs for the cathode material.

18. A thermionic dispenser type cathode comprising an emissive member comprising a backing plug, a nonporous reservoir of active cathode material adjacent the backing plug and a thin foil on the outer surface of the reservoir, the foil being formed from a least one refractory metal with a set of uniformly sized and regularly spaced slots therein to permit the active electron-emitting material to migrate through the slots and to spread over the exposed surface of the foil when the reservoir material is heated to the proper temperature, said slots having a width of 1-25 microns in one transverse direction on spacings of 5-100 microns and a length in a second transverse direction substantially larger than the width.

* * * * *